US009388687B2

(12) United States Patent
Dirksen et al.

(10) Patent No.: US 9,388,687 B2
(45) Date of Patent: Jul. 12, 2016

(54) FORMATION ENVIRONMENT SAMPLING APPARATUS, SYSTEMS, AND METHODS

(75) Inventors: Ronald Johannes Dirksen, Spring, TX (US); Mark A. Proett, Missouri City, TX (US); Jim Wilson, Montgomery, TX (US); Abbas Sami Eyuboglu, Conroe, TX (US); Lizheng Zhang, Humble, TX (US); Wei Zhang, Houston, TX (US); Abdolhamid Hadibeik, Travis, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/391,679

(22) PCT Filed: May 7, 2012

(86) PCT No.: PCT/US2012/036791

§ 371 (c)(1),
(2), (4) Date: Oct. 9, 2014

(87) PCT Pub. No.: WO2013/169224

PCT Pub. Date: Nov. 14, 2013

(65) Prior Publication Data

US 2015/0068736 A1 Mar. 12, 2015

(51) Int. Cl.

| | |
|---|---|
| ***E21B 49/08*** | (2006.01) |
| ***E21B 49/10*** | (2006.01) |
| ***E21B 33/12*** | (2006.01) |
| ***E21B 34/06*** | (2006.01) |
| ***E21B 44/00*** | (2006.01) |

(52) U.S. Cl.

CPC ..... *E21B 49/081* (2013.01); *E21B 33/12* (2013.01); *E21B 34/06* (2013.01); *E21B 44/005* (2013.01); *E21B 49/10* (2013.01)

(58) Field of Classification Search

CPC ..... E21B 49/10; E21B 49/081
USPC ..... 166/100
See application file for complete search history.

(56) References Cited

U.S. PATENT DOCUMENTS

| | | | | |
|---|---|---|---|---|
| 6,301,959 | B1 * | 10/2001 | Hrametz et al. | 73/152.23 |
| 7,458,419 | B2 | 12/2008 | Nold, III et al. | |
| 2004/0026125 | A1 * | 2/2004 | Meister et al. | 175/50 |

(Continued)

FOREIGN PATENT DOCUMENTS

| | | | |
|---|---|---|---|
| GB | 2418938 | A | 4/2006 |
| RU | 2379506 | C2 | 1/2010 |
| WO | WO-0043812 | A1 | 7/2000 |
| WO | WO-2013169224 | A1 | 11/2013 |

OTHER PUBLICATIONS

"International Application Serial No. PCT/US2012/036791, International Preliminary Report on Patentability mailed Sep. 16, 2014", 6 pgs.

(Continued)

*Primary Examiner* — Jennifer H Gay
*Assistant Examiner* — George Gray
(74) *Attorney, Agent, or Firm* — Schwegman Lundberg & Woessner, P.A.; Alan Bryson

(57) ABSTRACT

In some embodiments, an apparatus and a system, as well as a method and an article, may operate to advance a geological formation probe with a surrounding pad to seal the pad against a borehole wall, to adjust the size of the area associated with a fluid flow inlet of the probe, where the size of the inlet area is selectably and incrementally variable, and to draw fluid into the fluid flow inlet by activating at least one pump coupled to at least one fluid passage in the probe.

23 Claims, 8 Drawing Sheets

(56) References Cited

U.S. PATENT DOCUMENTS

| | | | | |
|---|---|---|---|---|
| 2006/0000603 | A1 | 1/2006 | Zazovsky et al. | |
| 2008/0295588 | A1 * | 12/2008 | van Zuilekom et al. | 73/152.26 |
| 2009/0101339 | A1 * | 4/2009 | Zazovsky et al. | 166/250.01 |
| 2011/0162836 | A1 | 7/2011 | Church | |

OTHER PUBLICATIONS

"International Application Serial No. PCT/US2012/036791, International Search Report and Written Opinion mailed Dec. 4, 2012", 11 pgs.

"International Application Serial No. PCT/US2012/036791, Written Opinion mailed Jun. 17, 2014", 5 pgs.

"Australian Application Serial No. 2012379666, First Examiner Report mailed Jul. 20, 2015", 2 pgs.

"International Application Serial No. PCT/US2012/036791, Response filed Jan. 17, 2013 to Written Opinion mailed Dec. 4, 2012", 6 pgs.

"International Application Serial No. PCT/US2012/036791, Response filed Jul. 8, 2014 to Written Opinion mailed Jun. 17, 2014", 6 pgs.

European Application Serial No. 12724439.0, Office Action mailed Apr. 11, 2016, 3 pgs.

Russian Application Serial No. 2014146929, Office Action mailed Mar. 21, 2016, (w/ English Translation), 13 pgs.

* cited by examiner

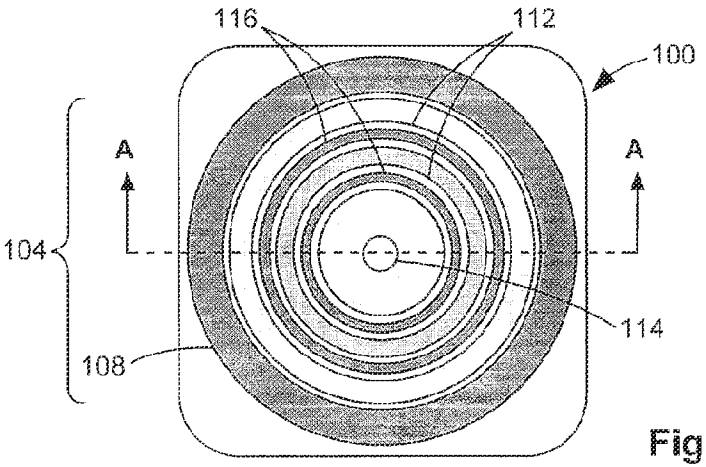
Fig. 1A
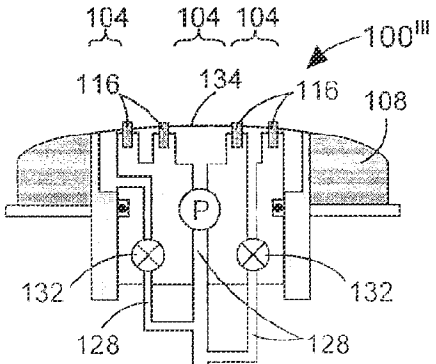
Fig. 1B
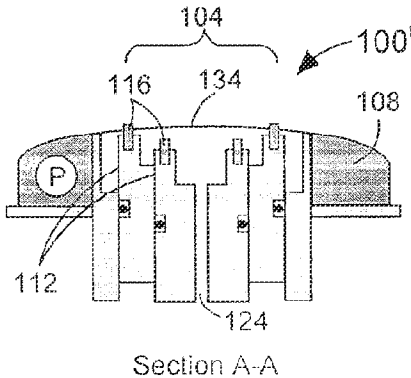
Fig. 1C
Fig. 1D

FORMATION ENVIRONMENT SAMPLING APPARATUS, SYSTEMS, AND METHODS

PRIORITY APPLICATION

This application is a U.S. National Stage Filing under 35 U.S.C. 371 from International Application No. PCT/US2012/036791, filed on 7 May 2012, the application is incorporated herein by reference in its entirety.

BACKGROUND

Sampling programs are often conducted in the oil field to reduce risk. For example, the more closely that a given sample of formation fluid represents actual conditions in the formation being studied, the lower the risk of inducing error during further analysis of the sample. This being the case, down hole samples are usually preferred over surface samples, due to errors which accumulate during separation at the well site, remixing in the lab, and the differences in measuring instruments and techniques used to mix the fluids to a composition that represents the original reservoir fluid. However, down hole sampling can also be costly in terms of time and money, such as when sampling time is increased because sampling efficiency is low.

BRIEF DESCRIPTION OF THE DRAWINGS

FIG. 1A is a top plan view, and FIGS. 1B-1D are sectioned side views of geological formation sampling and guard probes, according to various embodiments of the invention.

DETAILED DESCRIPTION

Figure 2B:
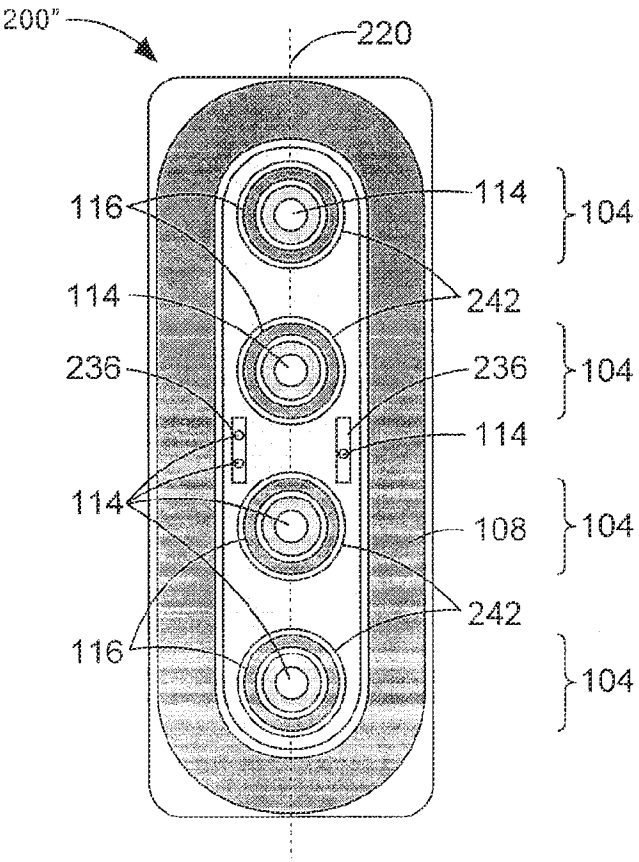
FIGS. 2A and 2B illustrate top plan views of additional embodiments of a geological formation sampling and guard probe according to various embodiments of the invention.

The oil and gas industry uses formation pressure testing tools to measure the pressure of fluids (including gases) and their mobility in subterranean geological formations. These include wireline or drill pipe-conveyed devices, such as the Halliburton® RDT™ and HSFT-II™ tools, and the Halliburton® GeoTap® tool.

Geological formations can present a wide range of pressures, fluid characteristics (e.g., viscosity), and permeability. To facilitate rapid, accurate measurements, down hole sampling tools sometimes have the capability to vary the drawdown volume and rate to achieve a selectable drawdown pressure and pressure build-up profile. For example, drawdown volume and rate can be controlled to reduce the chance of plugging flow lines, which sometimes occurs when the pressure differential during the drawdown is large and the rock in front of the sample probe fails, driving rock particles to enter the sample flow line. The drawdown rate can be used during sampling to control pressures and avoid phase changes in the fluid. Thus, when sampling, pressure adjustments can be made by varying the drawdown rate to keep the sample fluid above the bubble point.

In a conventional drawdown sampling sequence, a sampling probe is retracted and the probe conveyance (e.g., a formation testing tool) is moved down hole to a depth where the test point is located. An equalization valve is opened to make it possible to measure the well bore hydrostatic pressure prior to testing. When the formation tester is located at the testing depth, the sampling probe is extended to make a sealing engagement with the borehole rock face. Before or while the sampling probe is deployed, the equalization valve is closed to isolate the flow line (which is hydraulically connected to a pressure gauge, probe, and pretest chamber) from the borehole.

During scaling engagement of the sampling probe with the rock face, there is frequently a pressure change (e.g., a slight increase) measured by the pressure gauge, which can be caused by the sealing action of the sampling probe and/or the equalization valve closure. Then a pretest piston is moved at a controlled rate to reduce pressure in the flow line and at the sampling probe, starting the drawdown time. As the piston moves, the pressure decreases and ideally stabilizes at a desired drawdown pressure, which is primarily controlled by the rate the pretest piston moves. This is also the case when sampling, where a long pumping period is used to remove well bore fluid in the formation in the vicinity of the probe so that a relatively uncontaminated sample can be obtained. In some cases the formation tester pump is used to perform a pressure test, much like a pretest.

After the pretest piston stops moving, the pressure buildup begins, which marks the end of the drawdown time. Other mechanisms can be used to terminate the drawdown activity, such as closing a valve to isolate the pretest piston, or pumping from the flowline—this may be known as a "shut-in". Usually, the pressure buildup rate mirrors the drawdown rate and the pressure stabilizes fairly quickly in a permeable formation (i.e., a formation having a mobility of greater than 1 millidarcy/centipoise). The pressure buildup normally continues for several minutes until the final buildup pressure has stabilized.

In a formation with low permeability, such as a formation having a mobility of less than 1 millidarcy/centipoise, the fluid does not flow as easily into the sampling probe. Thus, when the pretest piston moves, most of the pressure decrease during drawdown is governed by expansion of the fluids in the flow line, so that the volume of fluid that actually flows into the formation represents only a fraction of the piston volume displaced.

When the piston stops moving or the flowline is shut-in, the pressure increases more slowly than the drawdown pressure decreases. This is because formation fluid is moving into the formation tester from the sampling probe sand face and recompressing the flow line fluids. Once the piston displacement volume has entered into the flow line the pressure eventually stabilizes, but this can take more than an hour, depending on several factors.

Equations have been developed to characterize the time it takes to change drawdown pressure (Pdd) and buildup pressure (Pbu). These are summarized as follows:

$$Pdd(t) = P_{f^*} - \beta\left(1 - e^{\frac{-t'}{\alpha}}\right), \text{ and} \quad [1]$$

$$Pbu(t) = P_{f^*} - \beta e^{\frac{-t}{\alpha}}, \quad [2]$$

where the system time constant $$\alpha = \frac{14696\mu}{2\pi k_s}\left(\frac{c_t V_{fl}}{r_p}\right)$$

(seconds), and the drawdown magnitude $$\beta = \frac{14696\mu}{2\pi k_s}\left(q_0 \frac{\tau_p}{r_p}\right)\left(1 - e^{\frac{-\Delta t_{dd}}{\alpha}}\right) \text{ (psi).}$$

The variables in these equations are known to those of ordinary skill in the art, and are defined as follows:

$q$=cc/sec, flow rate
$q_0$=cc/sec, drawdown flow rate
$r_s$=cm, probe radius
$r_p$=cm, probe radius
$M_s$=millidarcy/centipoise, mobility
$P_{f*}$=psi, formation pressure
$t_{s_dd}$=start of drawdown time
$t_{e_dd}$=end of drawdown time
$t'=T-t_{s_dd}$=seconds of drawdown time
$t=T-t_{e_dd}$=seconds of buildup time
T=sec, actual test time
$\tau_p$=probe shape factor
$c_t$=1/psia, total compressibility
$V_{fl}$=cc, flowline volume
$\Delta t_{dd}$=sec, drawdown time These equations and variables demonstrate that tool design can change the volumes and rates used to achieve a desired drawdown pressure. Because the inlet area of conventional sample probes is fixed in size, the standard method of controlling the drawdown pressure involves changes in the pretest volume and rate of movement. However, in low permeability, weak rock conditions, achieving a desired drawdown pressure can be difficult when the pretest volume and rate of movement are the only accessible variables.

The inventors have discovered a mechanism that can be used to achieve selected drawdown pressures even when low permeability conditions are present. This is accomplished by surrounding the sample probe with an adjustable guard probe to vary the total inlet size. While the prior art permits the guard probe inlet size to be selected statically, by retrieving the down hole tool to change out larger and smaller guard probes according to the anticipated formation testing conditions, various embodiments of the invention permit changing the size of the guard probe inlet size incrementally, and dynamically, without retrieving the tool, to accommodate a much wider range of such conditions.

Another advantage of the adjustable guard probe is improvements that can be achieved in the sampling process itself. In the prior art, there has been typically one guard probe used to focus the flow field near the probe to reduce sampling time. In some embodiments, having more than one guard probe, or flow rings around the sample probe, can enhance sampling capabilities when compared to a single guard ring. The focusing effect can be further tuned to improve sample quality or reduce sampling time. Furthermore, the shape of the guard does not necessarily need to be a simple ring around the sample probe—a variable inlet size and shape may be implemented to optimize both sampling and pressure testing based on the formation and fluid properties.

For example, in a low permeability formation, lower flow rates are often desirable. However there are limits to the rate control on most formation testers. At these times, a larger cross-sectional area on the guard probe can enhance the ability to control the drawdown pressure. If the guard probe surface inlet area size can also be made smaller, this has the same effect as flowing at a higher rate for more permeable formations, further extending the range of useful operation associated with the attached formation testing tool.

Thus, an enhancement to varying pretest volume and rate is to vary the cross sectional flow area through which the fluid is drawn into the sampling device. In addition to the size of the guard, the guard shape can be varied—from a circular ring to an elliptical shape. Large packers that extend to seal the well bore above and below the sampling probe are used in some embodiments. These and other embodiments of the invention will now be described in more detail.

In some embodiments, a variable guard probe inlet area size can be achieved by controlling the guard probe inlet area (e.g., adjusting the effective radius of the guard probe inlet area, where the guard probe inlet area is mathematically equivalent to that possessed by a guard probe having a substantially circular inlet area configuration). One method of varying the guard probe inlet area size comprises controlling the size of one or more sealing areas through which formation fluid is drawn into the flow line. It is a combination of the guard probe sealing areas, which may have a variety of shapes, that make up the total guard probe inlet area size.

Thus, the guard probe inlet area size can be varied by using more than one scaling area, each having a fixed and/or variable size. Thus, in some embodiments, sealing surfaces are employed as circular sealing elements (e.g., arranged as a series of concentric or non-concentric sealing areas) comprising flexible sealing lips which are engaged, or disengaged with the borehole wall to create an equivalent guard probe inlet radius that matches the desired inlet area—one that is useful with respect to the particular formation conditions that are encountered. As a result, when down hole conditions change, the overall guard probe inlet area can be changed to match the changing conditions, to achieve the desired drawdown and buildup in a dynamic fashion, without moving the formation testing tool to physically change out the probe.

In another embodiment separate pretest pistons or pumps can be connected to each guard probe to control flow rates and pressures individually. By controlling the individual drawdown rates associated with each guard probe, pressures can be varied between the rings to achieve improved testing results. For example, by observing the different rates and pressures from the sampling probe and guard probes, it is possible to determine localized formation rock properties, such as the permeability, mobility, skin factor, and anisotropy. In this way, greater control of the flow field in the formation near the probes may operate to further improve sampling.

FIG. 1A is a top plan view 100, and FIGS. 1B-1D are sectioned side views 100' 100", 100'" of a geological formation sampling and guard probes, according to various embodiments of the invention. Each of the sectional views of the sampling and guard probes 100', 100", 100'" illustrates a different combination of engaging and disengaging a concentric series of sealing elements 112, effectively forming an inlet area 104 of variable size. This is a feature of many embodiments: the ability to change the probe flow inlet area while the testing tool is positioned at a single depth. The result of such flexibility is an expansion of formation testing and sampling capability, saving rig time.

Referring now to FIGS. IA-1D, it can be seen that a central sampling probe 114 is surrounded by concentric sealing elements 112 which can be sealingly engaged with the wall of the well bore. The sealing elements 112 may comprise a metallic base with an elastomeric lip 116, where the lip 116 may be made of rubber. The flow through the inlet area 104 is adjustable using the sealing elements 112, which can be activated by advancing them to engage the sealing area against the well bore, or retracting them to expose an additional amount of flow inlet area using a control mechanism in the sampling and guard probe 100, or a tool attached to the sampling and guard probe 100. One or more sealing pads 108 may surround the inlet area 104, to include one or more selectable sealing elements 112.

Valves 132, internal or external to the formation sampling and guard probe 100, can be used to control the flow of fluid in some embodiments (e.g., in sampling and guard probe 100'''). Fluid flow is guided by the sealing elements 112, through the flow inlet area(s) 104. The valves 132 can be automatically activated to achieve a desired drawdown pressure and flow area, perhaps using embedded sensors P, such as pressure sensors. The sealing elements 112 and/or the valves 132 may be used to selectively couple one or more fluid passages 128 from the inlet area(s) 104 to a single fluid flow line 124. One or more pumps (see pumps 344 in FIG. 3) may be coupled to one or more of the sealing elements 112, via the valves 132 or directly, to adjust the pumping pressure for each sealing element 112, if desired.

Figure 2A:
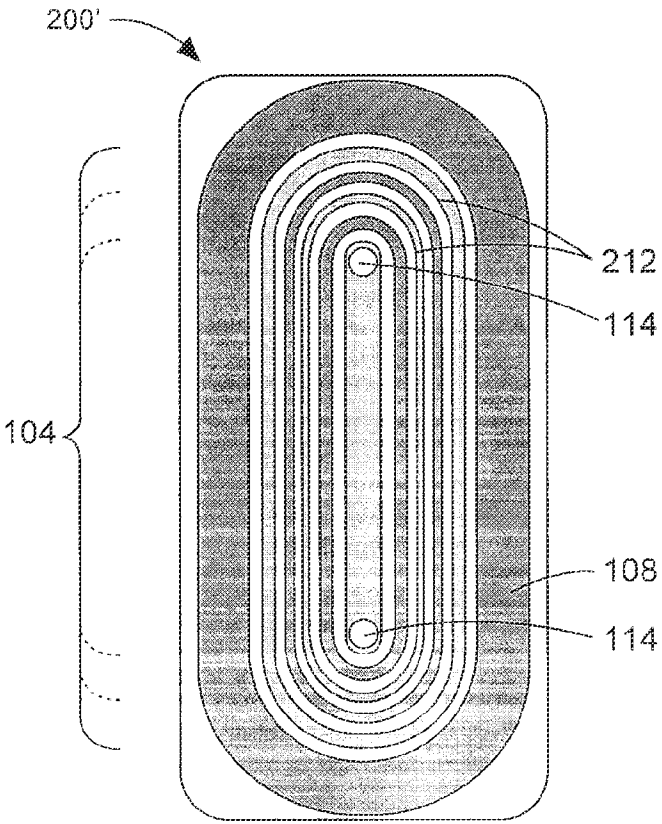

FIGS. 2A and 2B illustrate top plan views of additional embodiments of a geological formation sampling and guard probe 200 according to various embodiments of the invention. Here it can be seen that the probe inlet area 104 can also be varied by using multiple sealing elements 212 (surrounding multiple sampling probes 114, if desired) with different apertures, shapes, and relative locations. In these sampling and guard probes 200', 200" an elongated oval shape (e.g., a stadium shape) is shown to include various sealing element 212 configurations.

In the example of sampling and guard probe 200', an elongated oval shaped aperture defined by the sealing pad 108 is used with multiple sampling probes 114 and concentric sealing elements 212 to vary the guard probe inlet area 104 and thus, the equivalent inlet radius. In the example of sampling and guard probe 200", several non-concentric sealing elements 212 and probes 114 are located within the area defined by the sealing pad 108. In each case, the effective inlet area 104 of the geological formation sampling and guard probe 200 can be varied by engaging one or more sealing elements 212 that cooperate to define the inlet area 104. This can be accomplished by advancing the sealing elements 212 into scaling engagement with the well bore, by using mechanical movement, valves, and/or pumps, as described previously. When individual sampling probes 114 are surrounded by one or more larger probe sealing areas, the respective inlets 112, 212 can be engaged separately, or in combination with the individual sampling probes 114. Again, valves and/or pumps may be used to effectively vary the composite inlet area 104 for the geological formation sampling and guard probe 100, 200.

In some cases, a plurality of non-concentric slots 236 are disposed as sealing elements within the inlet area 104 (one or more sampling probes 114 can be disposed within each of the slots 236). The longitudinal axis of each slot 236 may be substantially parallel to the longitudinal axis 220 of the sampling and guard probe 200, as well as the longitudinal axis of the down hole tool. Although not shown, the longitudinal axis of each slot 236 may also be substantially perpendicular to the longitudinal axis 220 of the sampling and guard probe 200. Each slot 236 may be separately activated for sealing engagement with the well bore, perhaps using an elastomeric material to line the outer edge of the slot 236.

Figure 3A:
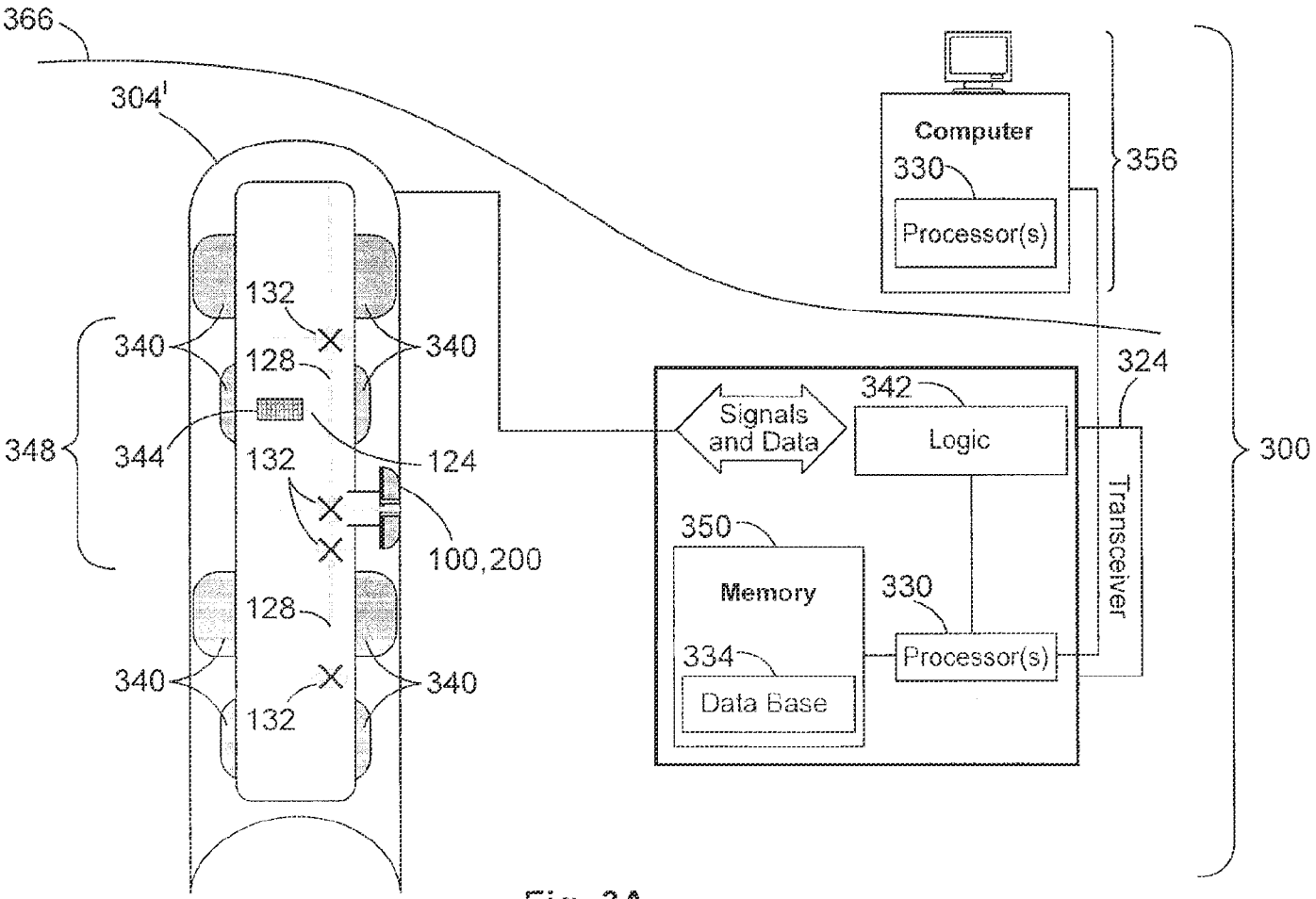
FIG. 3A is a block diagram of a data acquisition system and a down hole tool according to various embodiments of the invention.
Figure 3B:
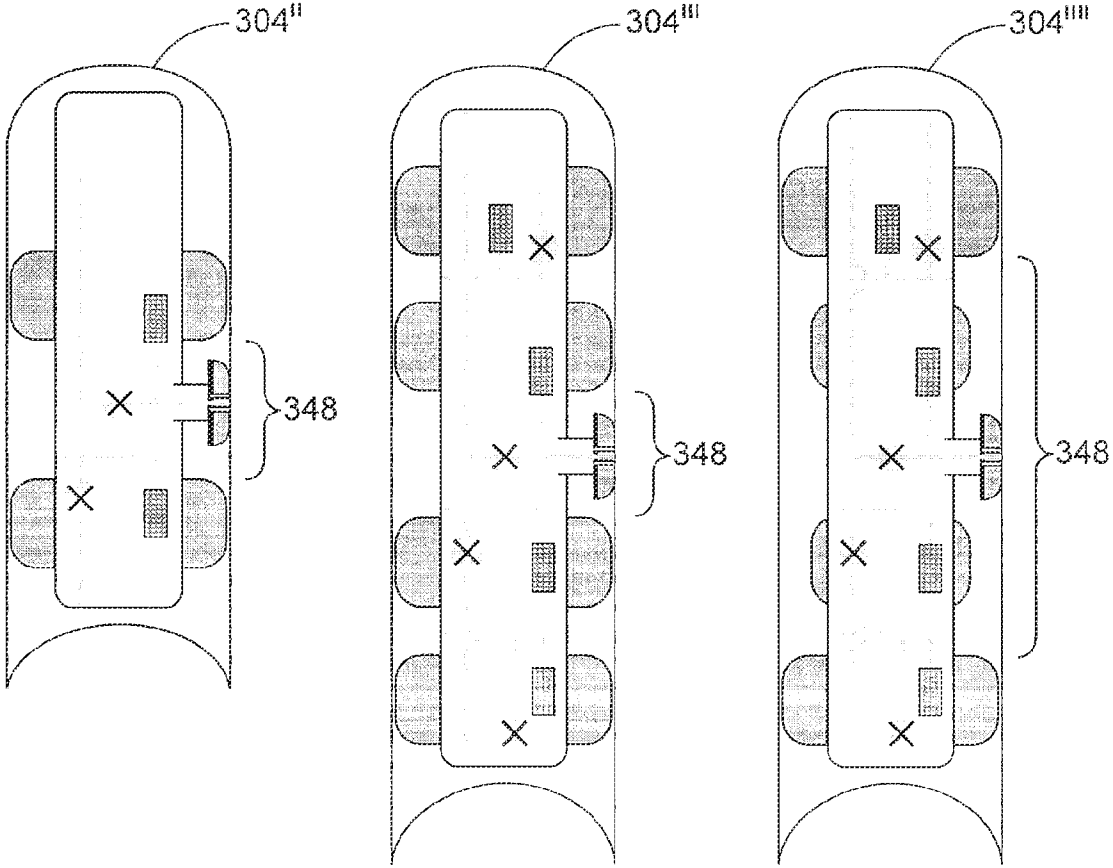
FIG. 3B illustrates down hole tools according to various embodiments of the invention.

FIG. 3A is a block diagram of a data acquisition system 300 and a down hole tool 304' according to various embodiments of the invention. FIG. 3B illustrates down hole tools 304", 304''', 304'''' according to various embodiments of the invention.

An apparatus that operates in conjunction with the system 300 may comprise a down hole tool 304 (e.g., a pumped formation evaluation tool) that includes one or more formation sampling and guard probes 100, 200, valves 132, straddle packers 340, and pumps 344. It should be noted that, while the down hole tool 304 is shown as such, some embodiments of the invention may be implemented using a wireline logging tool body. However, for reasons of clarity and economy, and so as not to obscure the various embodiments illustrated, this latter implementation has not been explicitly shown in this figure.

The system 300 may include logic 342, perhaps comprising a sampling control system. The logic 342 can be used to acquire flow line drawdown and buildup pressure data, as well as formation fluid property data.

The data acquisition system 300 may be coupled to the tool 304, to receive signals and data generated by the sampling and guard probes 100, 200, as well as from other sensors that may be included in the probe seals (e.g., sensors P in FIG. 1). The data acquisition system 300, and/or any of its components, may be located down hole, perhaps in a tool housing or tool body, or at the surface 366, perhaps as part of a computer workstation 356 in a surface logging facility.

In some embodiments of the invention, the down hole apparatus can operate to perform the functions of the workstation 356, and these results can be transmitted to the surface 366 and/or used to directly control the down hole sampling system, perhaps using a telemetry transceiver (transmitter-receiver) 344. Processors 330 may operate on data that is acquired from the sampling and guard probes 100, 200 and stored in the memory 350, perhaps in the form of a database 334. The operations of the processors 330 may result in the determination of various properties of the formation surrounding the tool 304.

In some embodiments, the action of variable inlet area sampling and guard probes 100, 200 can be combined with the operation of straddle packers 340. In this case the sampling and guard probes 100, 200 can be any of the types shown previously. Here the packers 340 can be individually activated to perform multiple tests at the same location, if desired. In addition, several sets of straddle packers 340 can be used with varied spacing, to vary the effective volume of fluid available to the sampling and guard probe(s) 100, 200.

Combining the action of multiple straddle packers 340 can greatly increase testing flexibility. A variety of smaller intervals, or even one large interval can all be tested, along with combinations of intervals. Examples of these types of variation can be seen with respect to the embodiments illustrated with respect to the down hole tools 304', 304", 304''', and 304''''. Having this variety available can sometimes be used to better identify the strata and variations of permeability over a given formation testing interval. These configurations can also enhance sampling activity, since the isolated interval surrounding the probe acts as a guard, drawing in the majority of invaded fluids, so the center sample probe can be used to collect the sample, as desired.

The use of multiple valves 132 and pumps 344, as shown, provides a variety of different fluid flow paths. For example, while it has been shown previously that the flow lines can be connected to a single pretest cylinder or pump (e.g., via the single flow line 124 in FIG. 1), it is also possible to connect each section and/or inlet of a sampling and guard probe 100, 200 or the packer interval to a separate pump 344 or pretest chamber, perhaps using individual fluid passages 128. Probes similar to those in FIG. 1 can also be used to increase the testing and sampling flexibility. This enables regulating the drawdown/buildup flow and pressure at each exposed portion of the well bore.

This combined mechanism sometimes permits fluid sensors to detect contamination and fluid types within each section, further enhancing the sampling capability of the interval of the tool 304. In essence, this configuration provides independently selectable sample chambers 348. For example, various analysis methods can be employed using separate flow paths, such as interference testing between exposed flow areas to determine permeability anisotropy. Thus, referring now to FIGS. 1-3, it can be seen that many embodiments may be realized.

For example, an apparatus may comprise a geological formation sampling and guard probe 100, 200 having at least one sealing element 112, 212 to provide an inlet area 104 of selectable, incrementally variable size. For the purposes of this document, an inlet area that is "incrementally variable" in size means that the guard probe inlet area size is designed to be adjusted upward or downward in a finite number of fixed increments, as occurs with the use of multiple sealing elements defining scaling areas that can be selectively applied to the borehole wall in sealing engagement—per several embodiments described herein. It is not meant to include guard probes, if such exist, with a continuously variable inlet size, providing a substantially unlimited number of possible area combinations.

The selection of inlet area size may be controlled by a processor. Thus, the apparatus may comprise a processor 330 to adjust the size, based on a drawdown pressure sensor response (e.g., from the sensor P).

The sampling and guard probes 100, 200 may have more than one sealing pad, or only one sealing pad. Thus, the apparatus may comprise a single sealing pad 108 surrounding the inlet area 104 containing at least one selectable internal sealing element. These elements may comprise the sealing elements 112, 212. Thus, the inlet area 104 of the apparatus may comprise a plurality of independently movable, concentric sealing elements 112, 212 (see FIGS. 1A and 2A) or non-concentric sealing elements 242 (see FIG. 2B).

The inlet area 104 may have multiple movable or stationary sealing elements (e.g., when the sealing elements 112, 212, 242 are not extendable or retractable), of the same or differing size. Each of the sealing elements, whether movable or stationary, can be activated independently by coupling one or more of them to a flow line 124. Thus, in some embodiments, the inlet area 104 comprises a plurality of non-concentric, movable or non-movable, sealing elements (e.g., sealing elements 242, fabricated as stationary inlets in FIG. 2B), disposed within the inlet area 104.

Separate inlets may be disposed along a line within the inlet area (e.g., along the longitudinal axis of the probe 220, which may be substantially parallel to the longitudinal axis of the down hole tool). Thus, in some embodiments, the plurality of non-concentric inlets 242 is substantially linearly disposed within the inlet area 104.

The inlet area 104 may be constructed in a variety of shapes, perhaps comprising a combination of smaller areas. For example, an inlet area 104 having a substantially circular shape (see FIG. IA) may be relatively easy to fabricate, whereas an inlet area 104 formed as a stadium (see FIG. 2A) may be more difficult to make, but also more effective in sealing the probe (e.g., using less suction over a given area) from its surrounding environment within the bore hole. An oblong or elliptical design (e.g., the stadium shape) may also provide stratification information that is otherwise unavailable when a non-oblong (e.g., round or square) inlet area 104 is used.

Multiple fluid passages from the guard probe to the flow line in the tool may be determined by the physical construction of the inlet area 104, and the relative location of inlet area parts (e.g., concentric sealing elements), to direct fluid samples from the probe face 134 to the internal flow line 124. Thus, in some embodiments, a plurality of fluid passages 128 can be selectively coupled from the inlet area 104 to a single fluid flow line 124 via moving concentric sealing elements 112 toward, or away from, a sealing contact point on the face 134 of the sampling and guard probe 100, 200.

Multiple fluid passages 128 from the sampling and guard probe 100, 200 to the flow line 124 may be opened/closed by valves 132, and are generally used to direct fluid samples from the probe face 134 to the internal flow line 124, either sequentially, or substantially simultaneously. Thus, an apparatus may comprise a plurality of valves 132 to selectively couple a corresponding plurality of fluid passages 128 from the inlet area 104 to a single fluid flow line 124.

One or more sensors P can be embedded in the seal 108, the passage 128, and/or the flow line 124. Thus, the apparatus may comprise one or more sensors P, such as a drawdown/buildup pressure sensor. Still further embodiments may be realized.

Figure 4:
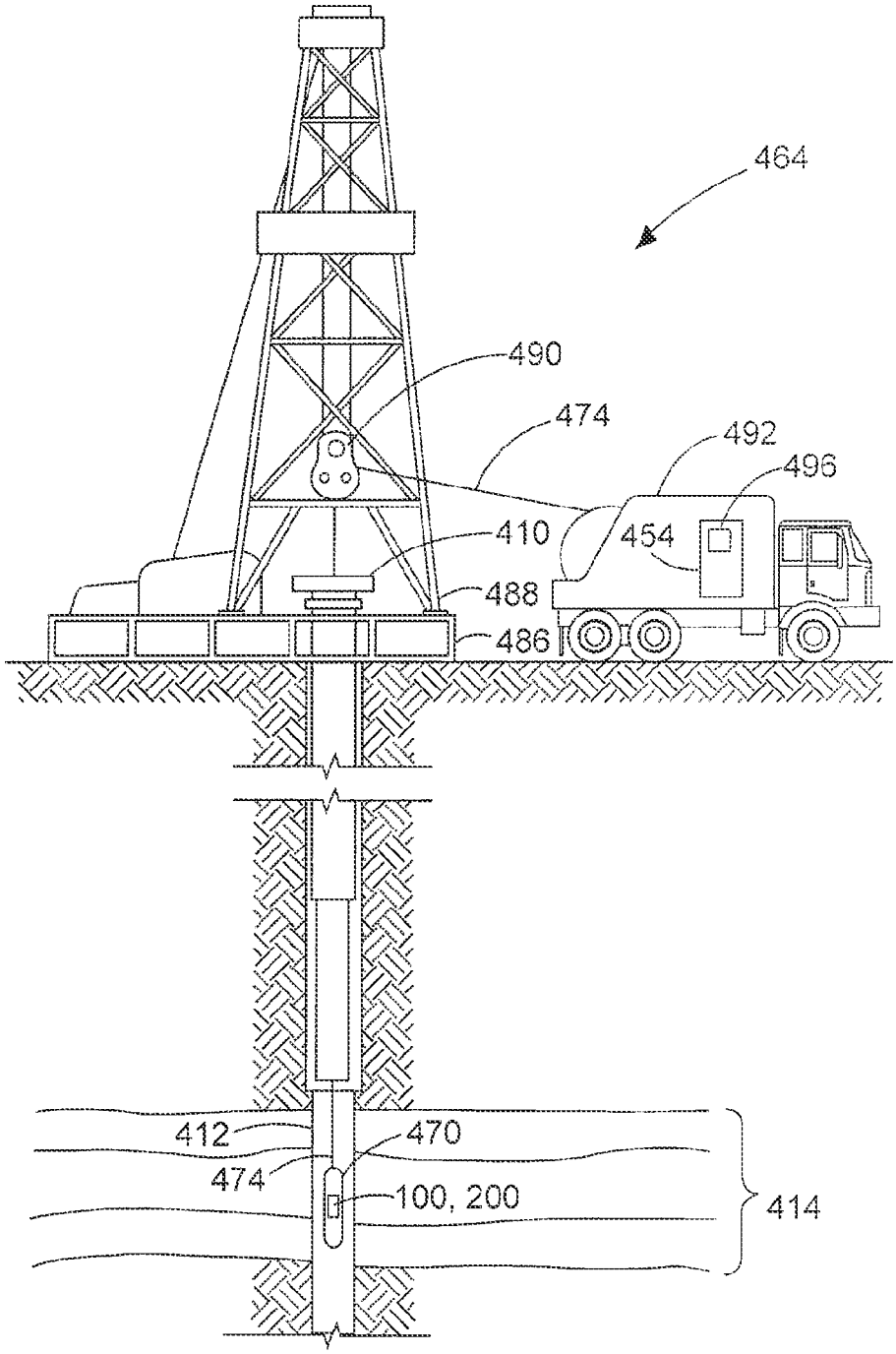
FIG. 4 illustrates a wireline system embodiment of the invention.
Figure 5:
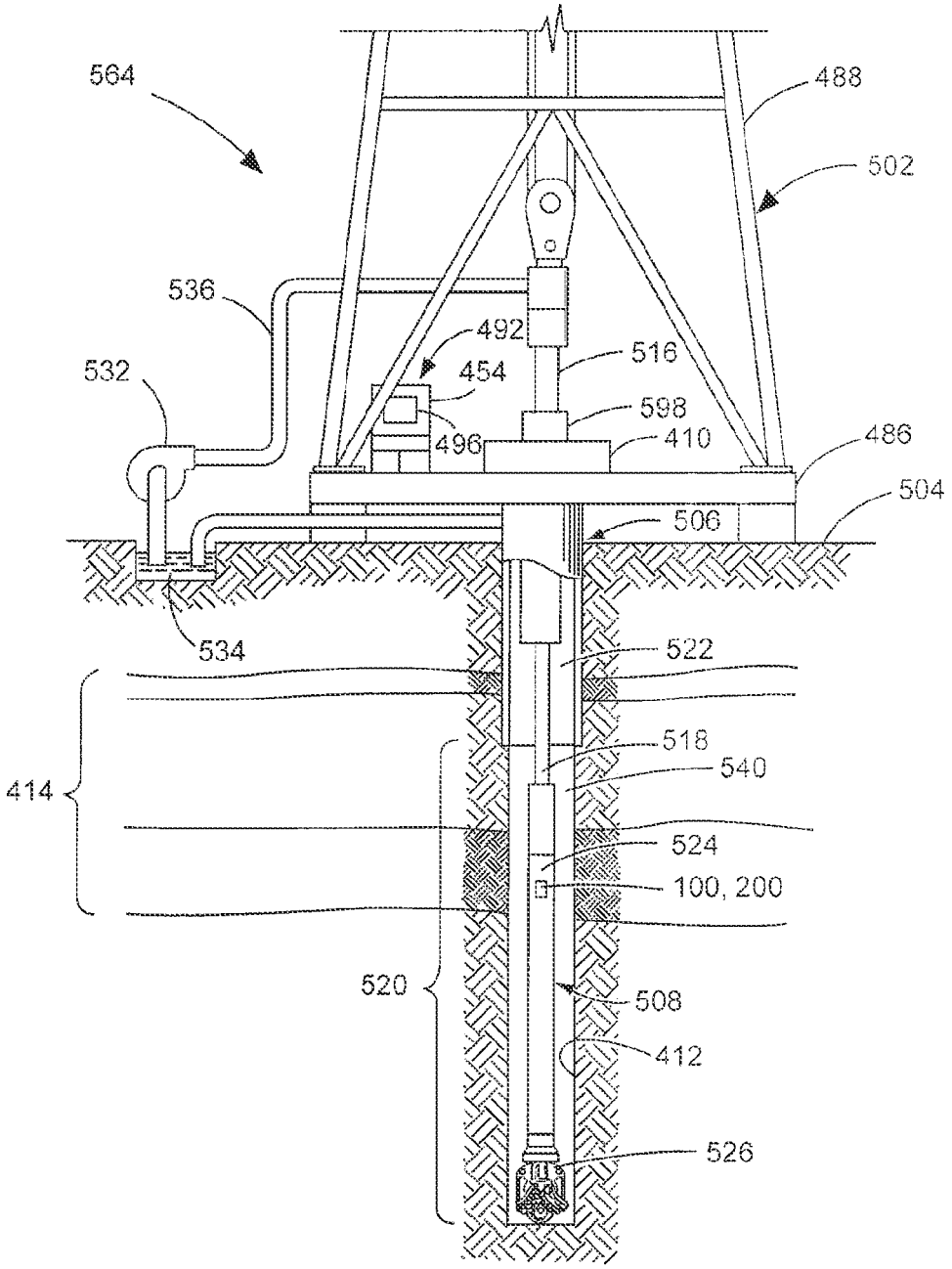
FIG. 5 illustrates a while-drilling system embodiment of the invention.

For example, FIG. 4 illustrates a wireline system 464 embodiment of the invention, and FIG. 5 illustrates a while-drilling system 564 embodiment of the invention. Thus, the systems 464, 564 may comprise portions of a tool body 470 as part of a wireline logging operation, or of a down hole tool 524 as part of a down hole drilling operation.

FIG. 4 shows a well during wireline logging operations. A drilling platform 486 is equipped with a derrick 488 that supports a hoist 490.

The drilling of oil and gas wells is commonly carried out using a string of drill pipes connected together so as to form a drilling string that is lowered through a rotary table 410 into a wellbore or borehole 412. Here it is assumed that the drill string has been temporarily removed from the borehole 412 to allow a wireline logging tool body 470, such as a probe or sonde, to be lowered by wireline or logging cable 474 into the borehole 412. Typically, the tool body 470 is lowered to the bottom of the region of interest and subsequently pulled upward at a substantially constant speed.

During the upward trip, at a series of depths the tool movement can be paused and the tool set to pump fluids into the sampling and guard probes 100, 200 included in the tool body 470. Various instruments (e.g., sensors) may be used to perform measurements on the subsurface geological formations 414 adjacent the borehole 412 (and the tool body 470). The measurement data may be stored and/or processed down hole (e.g., via subsurface processor(s) 330, logic 342, and memory 350) or communicated to a surface logging facility 492 for storage, processing, and analysis. The logging facility 492 may be provided with electronic equipment for various types of signal processing, which may be implemented by any one or more of the components of the system 300 in FIG. 3. Similar formation evaluation data may be gathered and analyzed during drilling operations (e.g., during logging while drilling (LWD) operations, and by extension, sampling while drilling).

In some embodiments, the tool body 470 comprises a formation testing tool for obtaining and analyzing a fluid sample from a subterranean formation through a wellbore. The formation testing tool is suspended in the wellbore by a wireline cable 474 that connects the tool to a surface control unit (e.g., comprising a workstation 356 as depicted in FIG. 3 or the like). The formation testing tool may be deployed in the wellbore on coiled tubing, jointed drill pipe, hard-wired drill pipe, or via any other suitable deployment technique.

Turning now to FIG. 5, it can be seen how a system 564 may also form a portion of a drilling rig 502 located at the surface 504 of a well 506. The drilling rig 502 may provide support for a drill string 508. The drill string 508 may operate to penetrate a rotary table 410 for drilling a borehole 412 through subsurface formations 414. The drill string 508 may include a kelly 516, drill pipe 518, and a bottom hole assembly 520, perhaps located at the lower portion of the drill pipe 518.

The bottom hole assembly 520 may include drill collars 522, a down hole tool 524, and a drill bit 526. The drill bit 526 may operate to create a borehole 412 by penetrating the surface 504 and subsurface formations 414. The down hole tool 524 may comprise any of a number of different types of tools including MWD (measurement while drilling) tools, LWD tools, and others.

During drilling operations, the drill string 508 (perhaps including the kelly 516, the drill pipe 518, and the bottom hole assembly 520) may be rotated by the rotary table 410. In addition to, or alternatively, the bottom hole assembly 520 may also be rotated by a motor (e.g., a mud motor) that is located down hole. The drill collars 522 may be used to add weight to the drill bit 526. The drill collars 522 may also operate to stiffen the bottom hole assembly 520, allowing the bottom hole assembly 520 to transfer the added weight to the drill bit 526, and in turn, to assist the drill bit 526 in penetrating the surface 504 and subsurface formations 414.

During drilling operations, a mud pump 532 may pump drilling fluid (sometimes known by those of skill in the art as "drilling mud") from a mud pit 534 through a hose 536 into the drill pipe 518 and down to the drill bit 526. The drilling fluid can flow out from the drill bit 526 and be returned to the surface 504 through an annular area 540 between the drill pipe 518 and the sides of the borehole 412. The drilling fluid may then be returned to the mud pit 534, where such fluid is filtered. In some embodiments, the drilling fluid can be used to cool the drill bit 526, as well as to provide lubrication for the drill bit 526 during drilling operations. Additionally, the drilling fluid may be used to remove subsurface formation cuttings created by operating the drill bit 526.

Thus, referring now to FIGS. 1-5, it may be seen that in some embodiments, a system 464, 564 may include a down hole tool 304, 524, and/or a wireline logging tool body 470 to house one or more apparatus and/or systems, similar to or identical to the apparatus and systems described above and illustrated in FIGS. 1-3. Wireline tools are frequently adapted for use in a drill string when wireline conveyance is not possible. For example, this may be the case to accommodate highly deviated boreholes or horizontal wells. Thus, for the purposes of this document, the term "housing" may include any one or more of a down hole tool 304, 524 or a wireline logging tool body 470 (each having an outer wall that can be used to enclose or attach to instrumentation, sensors, fluid sampling devices, such as probes, pressure measurement devices, such as sensors, seals, processors, and data acquisition systems). The down hole tool 304, 524 may comprise an LWD tool or MWD tool. The tool body 470 may comprise a wireline logging tool, including a probe or sonde, for example, coupled to a logging cable 474. Many embodiments may thus be realized.

For example, in some embodiments a system 464, 564 may comprise a housing and one or more geological formation sampling and guard probes 100, 200 mechanically coupled to the housing. The geological formation probes 100, 200 may have one or more fluid inlets with an inlet area of selectable, incrementally variable size.

The probes 100, 200 described herein can thus be attached to a variety of housings. For example, the housing may comprise a wireline tool body 470 or a down hole tool 304, 524, such as an MWD tool.

In some embodiments, the system 464, 564 may include straddle packers to capture fluid between the housing and the borehole wall. Thus, the system 464, 564 may comprise independently activated straddle packers 340 mechanically coupled to the housing, the packers 340 configurable to isolate fluid along a selected length of the housing and/or to bound the fluid volume available for intake by the probes 100, 200 when the probes 100, 200 are not in contact with the borehole wall (e.g., see FIG. 3).

In some embodiments, a system 464, 564 may include a display 496 to present the pumping volumetric flow rate, measured saturation pressure, seal pressure, probe pressure, and other information, perhaps in graphic form. A system 464, 564 may also include computation logic, perhaps as part of a surface logging facility 492, or a computer workstation 454, to receive signals from fluid sampling devices (e.g., probes 100, 200), multi-phase flow detectors, pressure measurement devices (e.g., sensors P), probe displacement measurement devices, and other instrumentation to determine adjustments to be made to the seal placement and pump in a fluid sampling device, to determine the quality of the borehole seal contact, as well as various formation characteristics.

The geological formation sampling and guard probes 100, 200; sealing pads 108; sealing elements 112, 212; sampling probes 114; fluid line 124; fluid passages 128; valves 132; slots 236; systems 300, 464, 564; down hole tool 304, 524; processors 330; database 334; straddle packers 340; logic 342; pumps 344; memory 350; workstation 356; rotary table 410; tool body 470; drilling platform 486; derrick 488; hoist 490; logging facility 492; display 496; drilling rig 502; drill string 508; kelly 516; drill pipe 518; bottom hole assembly 520; drill collars 522; down hole tool 524; drill bit 526; mud pump 532; hose 536; and sensors P may all be characterized as "modules" herein.

Such modules may include hardware circuitry, a processor, memory circuits, software program modules and objects, firmware, and/or combinations thereof, as desired by the architect of the apparatus and systems 300, 464, 564, and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for logging operations, and thus, various embodiments are not to be so limited. The illustrations of apparatus and systems 300, 464, 564 are intended to provide a general understanding of the structure of various embodiments, and they are not intended to serve as a complete description of all the elements and features of apparatus and systems that might make use of the structures described herein.

Applications that may include the novel apparatus and systems of various embodiments may include electronic circuitry used in high-speed computers, communication and signal processing circuitry, modems, processor modules, embedded processors, data switches, application-specific modules, or combinations thereof. Such apparatus and systems may further be included as sub-components within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 6:
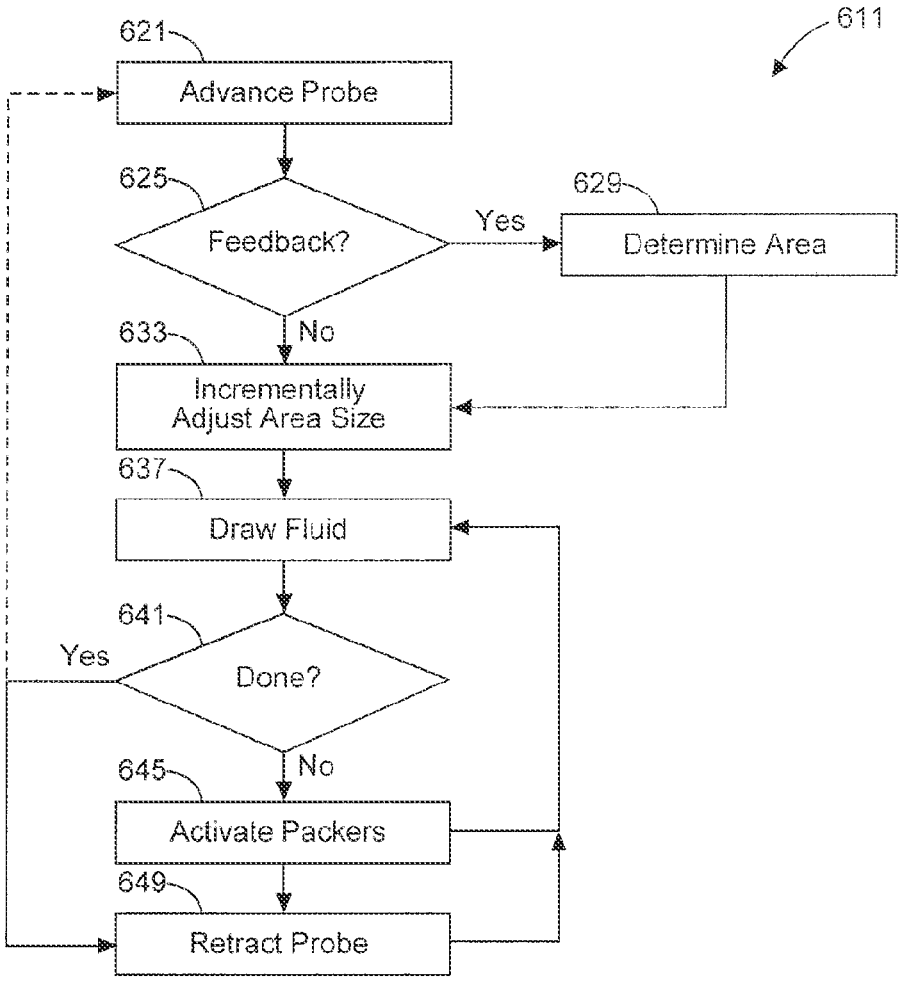
FIG. 6 is a flow chart illustrating several methods according to various embodiments of the invention.

For example, FIG. 6 is a flow chart illustrating several methods 611 of operating guard probes with selectable and incrementally variable inlet area size. Thus, a processor-implemented method 611 to execute on one or more processors that perform the method may begin at block 621 with advancing (as needed) a geological formation guard probe with a surrounding pad to seal the pad against a borehole wall.

The method 611 may continue on to block 625, to determine whether feedback is being used to adjust the inlet area size. For example, pressure sensor feedback can be used to adjust the size of the inlet area. If feedback is not used, the method 611 may advance directly to block 633 with adjusting the size of at least one inlet area of the guard probe, perhaps using a series of sealing elements, where the size of the inlet area is selectably and incrementally variable.

If feedback is used to adjust the inlet area size, then the method 611 may continue from block 625 on to block 629 with operating to determine the amount of feedback, and then go on to block 633 with adjusting the size of the inlet area based on the feedback. For example, the feedback can be provided by a sensor, such as a drawdown pressure sensor.

In some embodiments, the guard probe sealing elements are concentric, and the inlet area size is adjusted by advancing retracting one or more of the sealing elements. Thus, the activity of adjusting the inlet area size at block 633 may comprise advancing some of a set of concentric sealing elements included in the inlet area toward the borehole wall and/or retracting some of the set of concentric sealing elements included in the inlet area away from the borehole wall.

The method 611 may continue on to block 637 to include drawing fluid into the fluid inlet area by activating at least one pump coupled to at least one fluid passage in the guard probe.

Fluid can be drawn through one or more selected sealing elements—one at a time, or substantially simultaneously. Thus, the activity at block 637 may comprise selectively drawing the fluid through an electronically selected number of multiple non-concentric sealing element included in the inlet area.

The selection of fluid drawn into the inlet area can be controlled via separate pumps and/or valves. Thus, the activity at block 637 may comprise operating more than one pump or more than one valve coupled to the non-concentric sealing elements.

Straddle packers can be activated to capture fluid between the housing and the borehole wall; the captured fluid can then be taken into the probe without having the probe contact the borehole wall. Thus, the activity at block 637 can include drawing fluid captured by straddle packers into the fluid inlet area of one or more guard probes.

At block 641, the method 611 may include determining whether fluid sampling is complete. If so, the method 611 may continue on to block 649, or to block 621 in some embodiments.

If fluid sampling is not complete, in some embodiments, the method 611 may continue on to block 645 to include activating at least two straddle packers to capture the fluid as captured fluid between the straddle packers, a borehole tool, and the borehole wall.

In some embodiments, fluid can be drawn through the borehole wall, and from an area isolated by straddle packers, at different rates. The difference in pressure between the two activities can be used to determine formation permeability. Thus, the activity at block 637 may be accomplished with or without straddle packers at a first flow rate and a first fluid pressure, and then go on to activating (or re-activating) the straddle packers at block 645, and returning to block 637 to capture some of the fluid as captured fluid, drawing the captured fluid through the fluid inlet at a second rate different from the first rate, to determine a permeability of a formation associated with the borehole wall.

The method 611 may continue on to block 649 to include retracting the geological formation guard probe away from the borehole wall to break the seal of the pad against the borehole wall. Fluid may then be drawn into the guard probe, if straddle packers are used to isolate the probe, or the tool may be moved to a different depth in the bore hole, depending on the sampling process desired.

It should be noted that the methods described herein do not have to be executed in the order described, or in any particular order. Moreover, various activities described with respect to the methods identified herein can be executed in iterative, serial, or parallel fashion. Information, including parameters, commands, operands, and other data, can be sent and received in the form of one or more carrier waves.

The apparatus 100, 200 and systems 300, 464, 564 may be implemented in a machine-accessible and readable medium that is operational over one or more networks. The networks may be wired, wireless, or a combination of wired and wireless. The apparatus 100, 200 and systems 300, 464, 564 can be used to implement, among other things, the processing associated with the methods 611 of FIG. 6. Modules may comprise hardware, software, and firmware, or any combination of these. Thus, additional embodiments may be realized.

Figure 7:
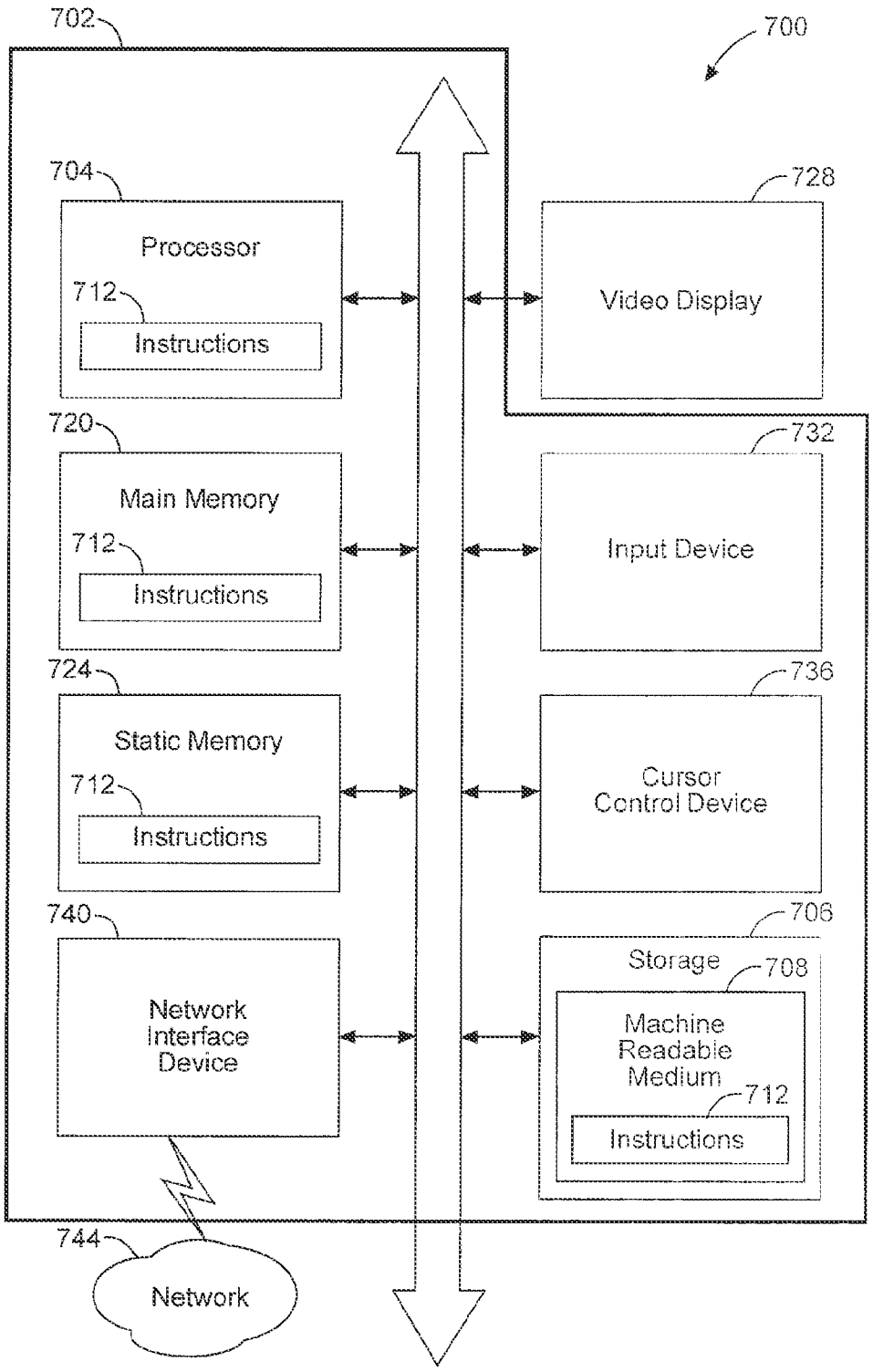
FIG. 7 is a block diagram of an article of manufacture, including a specific machine, according to various embodiments of the invention.

For example, FIG. 7 is a block diagram of an article 700 of manufacture, including a specific machine 702, according to various embodiments of the invention. Upon reading and comprehending the content of this disclosure, one of ordinary skill in the art will understand the manner in which a software program can be launched from a computer-readable medium in a computer-based system to execute the functions defined in the software program.

One of ordinary skill in the art will further understand the various programming languages that may be employed to create one or more software programs designed to implement and perform the methods disclosed herein. For example, the programs may be structured in an object-orientated format using an object-oriented language such as Java or C++. In another example, the programs can be structured in a procedure-oriented format using a procedural language, such as assembly or C. The software components may communicate using any of a number of mechanisms well known to those of ordinary skill in the art, such as application program interfaces or interprocess communication techniques, including remote procedure calls. The teachings of various embodiments are not limited to any particular programming language or environment. Thus, other embodiments may be realized.

For example, an article 700 of manufacture, such as a computer, a memory system, a magnetic or optical disk, some other storage device, and/or any type of electronic device or system may include one or more processors 704 coupled to a machine-readable medium 708 such as memory (e.g., removable storage media, as well as any memory including an electrical, optical, or electromagnetic conductor) having instructions 712 stored thereon (e.g., computer program instructions), which when executed by the one or more processors 704 result in the machine 702 performing any of the actions described with respect to the methods above.

The machine 702 may take the form of a specific computer system having a processor 704 coupled to a number of components directly, and/or using a bus 716. Thus, the machine 702 may be incorporated into the apparatus 100, 200 or system 300, 464, 564 shown in FIGS. 1-5, perhaps as part of the processor 330, or the workstation 356.

Turning now to FIG. 7, it can be seen that the components of the machine 702 may include main memory 720, static or non-volatile memory 724, and mass storage 706. Other components coupled to the processor 704 may include an input device 732, such as a keyboard, or a cursor control device 736, such as a mouse. An output device 728, such as a video display, may be located apart from the machine 702 (as shown), or made as an integral part of the machine 702.

A network interface device 740 to couple the processor 704 and other components to a network 744 may also be coupled to the bus 716. The instructions 712 may be transmitted or received over the network 744 via the network interface device 740 utilizing any one of a number of well-known transfer protocols (e.g., HyperText Transfer Protocol). Any of these elements coupled to the bus 716 may be absent, present singly, or present in plural numbers, depending on the specific embodiment to be realized.

The processor 704, the memories 720, 724, and the storage device 706 may each include instructions 712 which, when executed, cause the machine 702 to perform any one or more of the methods described herein. In some embodiments, the machine 702 operates as a standalone device or may be connected (e.g., networked) to other machines. In a networked environment, the machine 702 may operate in the capacity of a server or a client machine in server-client network environment, or as a peer machine in a peer-to-peer (or distributed) network environment.

The machine 702 may comprise a personal computer (PC), a tablet PC, a set-top box (STB), a PDA, a cellular telephone, a web appliance, a network router, switch or bridge, server, client, or any specific machine capable of executing a set of instructions (sequential or otherwise) that direct actions to be taken by that machine to implement the methods and functions described herein. Further, while only a single machine 702 is illustrated, the term "machine" shall also be taken to include any collection of machines that individually or jointly execute a set (or multiple sets) of instructions to perform any one or more of the methodologies discussed herein.

While the machine-readable medium 708 is shown as a single medium, the term "machine-readable medium" should be taken to include a single medium or multiple media (e.g., a centralized or distributed database, and/or associated caches and servers, and or a variety of storage media, such as the registers of the processor 704, memories 720, 724, and the storage device 706 that store the one or more sets of instructions 712. The term "machine-readable medium" shall also be taken to include any medium that is capable of storing, encoding or carrying a set of instructions for execution by the machine and that cause the machine 702 to perform any one or more of the methodologies of the present invention, or that is capable of storing, encoding or carrying data structures utilized by or associated with such a set of instructions. The terms "machine-readable medium" or "computer-readable medium" shall accordingly be taken to include tangible media, such as solid-state memories and optical and magnetic media.

Various embodiments may be implemented as a standalone application (e.g., without any network capabilities), a client-server application or a peer-to-peer (or distributed) application. Embodiments may also, for example, be deployed by Software-as-a-Service (SaaS), an Application Service Provider (ASP), or utility computing providers, in addition to being sold or licensed via traditional channels.

Using the apparatus, systems, and methods disclosed herein may afford formation evaluation clients the opportunity to more intelligently choose between repeating measurements and moving the tool. Additional data on rock properties that can be collected using various embodiments can inform the selection of future testing locations within the same formation, and wellbore, as well as determining how to adjust the guard probe inlet area to enhance sealing and/or prevent rock failure. Increased client satisfaction may result.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising: a geological formation probe operable in a well bore, the geological formation probe having at least one fluid flow inlet with an inlet area of selectable, incrementally variable size, and having a plurality of sealing elements within the at least one fluid flow inlet, each sealing element independently movable downhole with respect to the other sealing elements of the plurality and advanceable to engage a wall of the well bore in a sealing engagement and retractable from the sealing engagement, wherein the inlet area comprises a guard probe inlet area, the guard probe inlet area having an incrementally adjustable size by selective activation of selected ones of the plurality of sealing elements, and further wherein a first sealing element of the plurality of sealing elements is at least partially spaced from the at least one fluid flow inlet, the first sealing element being the nearest of the plurality of sealing elements to the at least one fluid flow inlet.

2. The apparatus of claim 1, further comprising:

a processor to adjust the size, based on a drawdown pressure sensor response.

3. The apparatus of claim 1, further comprising:

a single sealing pad surrounding the inlet area.

4. The apparatus of claim 1, wherein the plurality of sealing elements comprises:

a plurality of independently movable, concentric sealing elements.

5. The apparatus claim 1, wherein the plurality of sealing elements comprises:

a plurality of non-concentric, movable sealing elements, disposed within the inlet area.

6. The apparatus of claim 5, wherein the plurality of non-concentric inlets is substantially linearly disposed.

7. The apparatus of claim 1, wherein the inlet area is formed as a stadium.

8. The apparatus of claim 1, wherein a plurality of fluid passages is selectively coupleable from the inlet area to a single fluid flow line via moving at least one concentric sealing element toward, or away from, a sealing contact point on a face of the probe.

9. The apparatus of claim 1, further comprising:

a plurality of valves to selectively couple a corresponding plurality of fluid passages from the inlet area to a single fluid flow line.

10. The apparatus of claim 1, wherein the plurality of sealing elements are operable to jointly engage the wall of the wellbore.

11. A system, comprising: a housing; and a geological formation probe mechanically coupled to the housing, the geological formation probe operable in a well bore, the geological formation probe having at least one fluid flow inlet with an inlet area of selectable, incrementally variable size, and having a plurality of sealing elements within the at least one fluid flow inlet, each sealing element independently movable downhole with respect to the other sealing elements of the plurality and advanceable to engage a wall of the well bore in a sealing engagement and retractable from the sealing engagement, wherein the inlet area comprises a guard probe inlet area, the guard probe inlet area having an incrementally adjustable size by selective activation of selected ones of the plurality of sealing elements, and further wherein a first sealing element of the plurality of sealing elements is at least partially spaced from the at least one fluid flow inlet, the first sealing element being the nearest of the plurality of sealing elements to the at least one fluid flow inlet.

12. The system of claim 11, wherein the housing comprises one of a wireline tool or a measurement while drilling tool.

13. The system of claim 11, wherein the inlet area comprises:

a plurality of non-concentric slots disposed as sealing elements within the inlet area, a. longitudinal axis of each slot being substantially parallel to a longitudinal axis of the housing.

14. The system of claim 11, further comprising:

independently activatible straddle packers mechanically coupled to the housing, the packers configurable to isolate fluid along a selected length of the housing, to bound a fluid volume available for intake by the guard probe when the guard probe is not in contact with the borehole wall.

15. The apparatus of claim 11, wherein the plurality of sealing elements are operable to jointly engage the wall of the wellbore.

16. A processor-implemented method to execute on one or more processors that perform the method, comprising:

advancing a geological formation probe with a surrounding pad to seal the pad against a borehole wall, the geological formation probe having a plurality of sealing elements within a fluid flow inlet of the geological formation probe, each sealing element independently movable downhole with respect to the other sealing elements of the plurality and advanceable to engage a wall of the well bore in a sealing engagement and retractable from the sealing engagement, and further wherein a first sealing element of the plurality of sealing elements is at least partially spaced from the fluid flow inlet, the first sealing element being the nearest of the plurality of sealing elements to the fluid flow inlet;

adjusting a size of at least one inlet area of the fluid flow inlet of the probe, the size of the inlet area being selectably and incrementally variable, wherein the inlet area comprises a guard probe inlet area, the guard probe inlet area having an incrementally adjustable size by selective activation of selected ones of the plurality of sealing elements; and drawing fluid into the fluid flow inlet by activating at least one pump coupled to at least one fluid passage in the probe.

17. The method of claim 16, wherein the adjusting comprises:

adjusting the size based on feedback from a drawdown pressure sensor.

18. The method of claim 16, wherein the adjusting comprises:

advancing some of a set of concentric sealing elements included in the plurality of sealing elements in the inlet area toward the borehole wall, and/or retracting some of the set of concentric sealing elements included in the plurality of sealing elements in the inlet area away from the borehole wall.

19. The method of claim 16, further comprising:

activating at least two straddle packers to capture the fluid as captured fluid between the straddle packers, a borehole tool, and the borehole wall;

breaking the seal of the pad against the borehole wall; and drawing the captured fluid into the fluid flow inlet.

20. The method of claim 16, wherein the drawing comprises:

selectively drawing the fluid through an electronically selected number of multiple non-concentric sealing elements included in the plurality of sealing elements in the inlet area.

21. The method of claim 20, wherein selectively drawing further comprises:

operating more than one pump or more than one valve coupled to the non-concentric sealing elements.

22. The method of claim 16, wherein drawing the fluid is accomplished at a first flow rate at a first fluid pressure, further comprising:

activating straddle packers to capture some of the fluid as captured fluid; and drawing the captured fluid through the fluid flow inlet at a second rate different from the first rate, to determine a permeability of a formation associated with the borehole wall.

23. The method of claim 16, wherein the method includes operating the plurality of sealing elements to jointly engage the wall of the wellbore.

* * * * *